US005945178A

United States Patent [19]

Volkmann

[11] Patent Number: 5,945,178

[45] Date of Patent: Aug. 31, 1999

[54] FURNITURE FOOT COVER AND METHOD OF MANUFACTURE

[76] Inventor: Eric R. Volkmann, 512 N. Rock Glen Rd., Baltimore, Md. 21229

[21] Appl. No.: 08/872,539

[22] Filed: Jun. 10, 1997

[51] Int. Cl.[6] ..... A63F 7/00

[52] U.S. Cl. ..... 428/11; 248/188

[58] Field of Search ..... 428/7, 11; 248/188

[56] References Cited

U.S. PATENT DOCUMENTS

| | | | |
|---|---|---|---|
| D. 338,223 | 8/1993 | Mine | D17/99 |
| 1,921,561 | 8/1933 | Christmas | 16/42 R |
| 2,744,283 | 5/1956 | Reineman | 16/42 R |
| 2,865,133 | 12/1958 | Hoven et al. | 16/42 R |
| 2,994,152 | 8/1961 | Donahue | 248/188.9 |
| 3,199,819 | 8/1965 | Widmark | 248/188.9 |
| 3,791,899 | 2/1974 | Walters | 428/11 X |

*Primary Examiner*—Henry F. Epstein
*Attorney, Agent, or Firm*—Henderson & Sturm

[57] ABSTRACT

A furniture foot cover device 10 and its method of manufacture wherein a primary hollow resilient sphere 20 is provided with an opening 23 dimensioned to receive the lower portion 101 of a furniture foot 100. A major component 31 of a secondary hollow resilient sphere 30 is secured to the external 21 or internal 22 periphery of the primary resilient sphere 20 to provide reinforcement thereto.

20 Claims, 1 Drawing Sheet

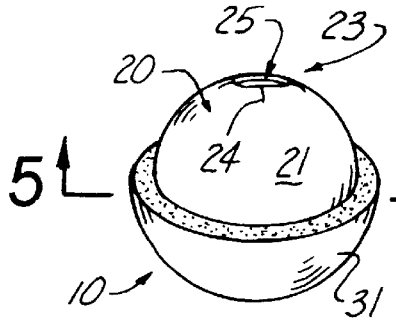
Fig. 1
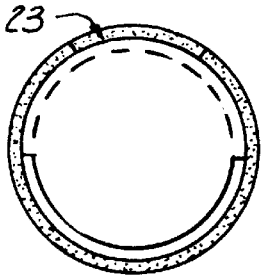
Fig. 3
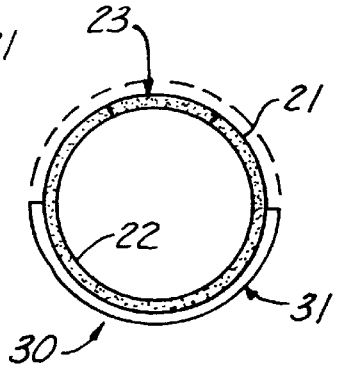
Fig. 4
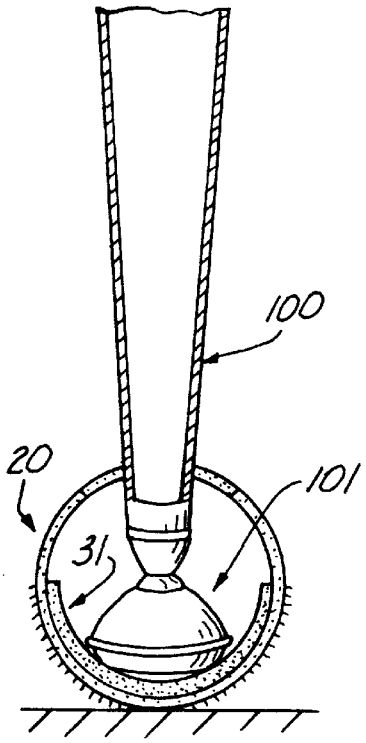
Fig. 2
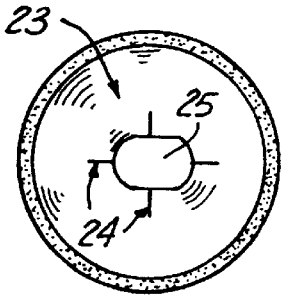
Fig. 5
Fig. 6
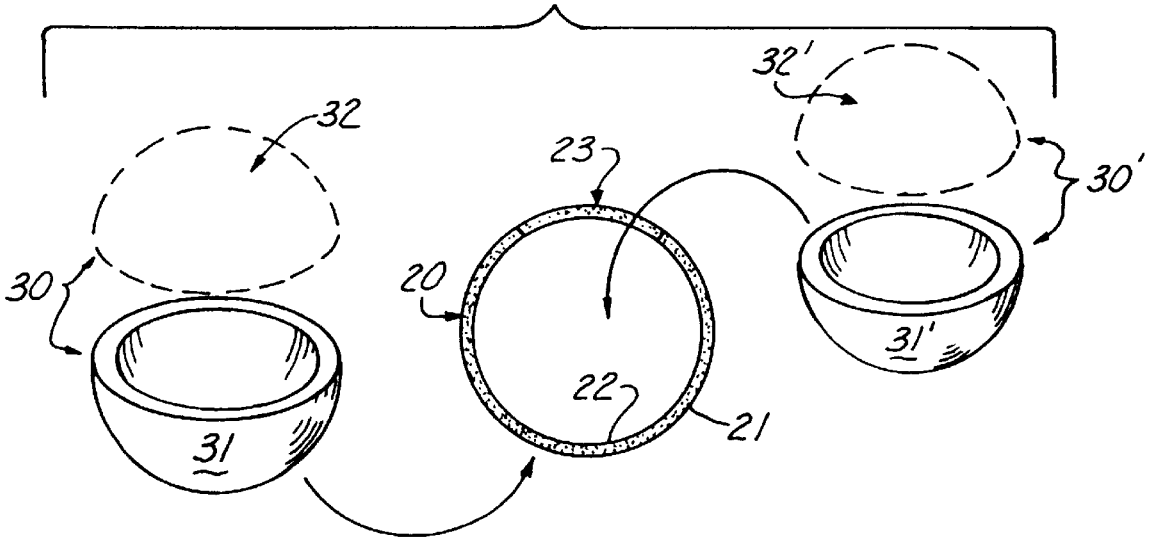

FURNITURE FOOT COVER AND METHOD OF MANUFACTURE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of reinforced furniture leg covers in general, and in particular to a stool foot cover fabricated from spheres and sphere segments and the method of making the same.

2. Description of Related Art

As can be seen by reference to the following U.S. Pat. Nos. 1,921,562; 2,865,133; 2,994,152; and Des. 338,223 the prior art is replete with myriad and diverse reinforced furniture leg covers.

While all of the aforementioned prior art constructions are more than adequate for the basic purpose and function for which they have been specifically designed, they are uniformly deficient with respect to their failure to provide a simple, efficient, and relatively inexpensive method of fabricating a new type of foot cover from readily available components.

As any teacher is aware, students generate a great deal of "movement noise" caused by desks and chair sliding along uncarpeted floors.

Unfortunately, most commercially available furniture foot covers are either too expensive or are only designed to fit a specific size leg of an article of furniture which makes them relatively impractical.

As a consequence of the foregoing situation, there has existed a longstanding need for a new and improved method of manufacturing a new type of furniture leg cover from readily available and inexpensive components that may have outlived the useful life for which they were specifically designed and the provision of such a device and its method of manufacture is a stated objective of the present invention.

BRIEF SUMMARY OF THE INVENTION

Briefly stated, the furniture foot cover and method of manufacture that forms the basis of the present invention involves a pair of resilient hollow spheres which are severed, slit and secured to one another in such a fashion to produce a reinforced thickness furniture foot cover in accordance with the teachings of this invention.

As will be explained in greater detail further on in the specification, the furniture foot cover device comprises a first hollow resilient sphere that is severed or otherwise divided into two separate major sphere components wherein one of the major sphere components is secured to the periphery of a second hollow resilient sphere.

In addition, the second hollow resilient sphere is provided with an opening dimensioned to receive a portion of the furniture foot cover device and the selected major sphere component may either be adhesively secured to the exterior periphery of the second resilient sphere or secured to the interior periphery by inserting the selected sphere component through the opening in the second resilient sphere.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the first version of the preferred embodiment of the furniture foot cover that forms the basis of the present invention;

FIG. 2 is a cross-section view of the second version of the preferred embodiment operatively engaged with a furniture foot;

FIG. 3 is an isolated cross-sectional view of the second version of the preferred embodiment;

FIG. 4 is a cross-sectional view of the first version of the preferred embodiment;

FIG. 5 is a cross-section view taken through line 5—5 of FIG. 1; and FIG. 6 is an exploded perspective view of the resilient sphere and major spherical components used in the fabrication of both versions of the preferred embodiment.

DETAILED DESCRIPTION OF THE INVENTION

As can be seen by reference to the drawings, and in particularly to FIG. 1, the furniture foot cover device that forms the basis of the present invention is designated generally by the reference number 10. The furniture foot cover device comprises in general, a primary hollow resilient sphere 20 and a major component 31 from a secondary hollow resilient sphere 30 wherein the major component 31 of the secondary hollow resilient sphere 30 may be secured on the external 21 or internal 22 periphery of the primary hollow resilient sphere 20 as will be explained in greater detail further on in the specification.

In the first version of the preferred embodiment depicted in FIGS. 1, 4, and 6, the secondary hollow resilient sphere 30 has an internal diameter that is approximately equal to, but greater than, the external diameter of the primary sphere 20.

In addition, as shown in FIG. 6, the secondary resilient sphere 30 is divided such as by severing or the like, into two major sphere components 31 and 32 wherein a selected one 31 of the major sphere components is secured such as by adhesives or the like to the external periphery 21 of the primary resilient sphere 20.

At this juncture, an opening 23 is formed in the primary resilient sphere 20 wherein the opening 23 is spaced from the location of the selected major sphere component 31.

As can also be seen by reference to FIGS. 1 and 5, the opening 23 in the primary resilient sphere 20 may comprise one or more intersecting slits 24 and/or a generally circular opening 25 formed by the removal of an arcuate segment from the primary resilient sphere 20 wherein the opening 23 is dimensioned to receive the lower portion 101 of a furniture foot 100 such as a desk, chair, or the like, as shown in FIG. 2.

In the second version of the preferred embodiment depicted in FIGS. 2, 3, and 6, the secondary hollow resilient sphere 30' has an external diameter approximately equal to, but less than, the internal diameter of the primary resilient sphere 20.

As was the case with the first version of the preferred embodiment, the secondary resilient sphere 30' is divided such as by severing or the like, into two major sphere components 31' and 32'. A selected one 31' of the major sphere components is inserted through the opening 23 and secured such as by adhesives or the like to the internal periphery 22 of the primary resilient sphere 20.

Given the fact that there are a plethora of hollow resilient spheres 20 and 30 that are commercially available at extremely low cost, the cost of the basic materials (e.g., rubber balls of different diameters, hardness, and resiliency, and adhesive) will result in a very simple, efficient, and inexpensive method of manufacturing the furniture foot cover devices 10 as described herein.

In addition, as suggested in FIG. 2, this invention contemplates the recycling of used tennis balls with their fuzzy exterior for either the primary resilient sphere 20 of the second version of the preferred embodiment or the major sphere component 31 of the first version of the preferred embodiment shown in FIGS. 1 and 4.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A method of manufacturing a furniture foot cover from a pair of resilient, hollow spheres comprising the steps of:

(a) severing one of the spheres into two approximately equal sphere components;

(b) forming an opening dimensioned to receive said furniture foot in said other resilient sphere; and (c) selecting one of said sphere components and securing the selected sphere component to the periphery of the other resilient sphere.

2. The method as in claim 1 including reversing steps (b) and (c).

3. The method as in claim 1 wherein step (b) includes removing an arcuate segment from said other resilient sphere to form a generally circular opening therein.

4. The method as in claim 3 wherein step (b) further includes forming at least one slit extending outwardly from said opening.

5. The method of claim 3 wherein step (b) further includes forming a plurality of slits extending outwardly from said opening.

6. The method as in claim 1 wherein step (b) includes forming at least one slit in the periphery of said other resilient sphere.

7. The method as in claim 1 wherein step (b) includes forming a plurality of intersecting slits in the periphery of said other resilient sphere.

8. The method as in claim 1 wherein said opening is disposed opposite from the location of said selected sphere component.

9. The method as in claim 1 wherein said sphere components comprise a major sphere component and a minor sphere component.

10. The method as in claim 1 wherein said opening is angularly offset from the location of said selected sphere component.

11. The method as in claim 1 where in the selected sphere component is secured to the exterior of the other resilient sphere.

12. The method as in claim 1 wherein the selected sphere component is secured to the interior of the other resilient sphere.

13. A furniture foot cover device comprising:

a first resilient hollow sphere having an opening formed therein; wherein said opening is dimensioned to receive said furniture foot; and a segment of a second resilient hollow sphere secured to the periphery of said first resilient sphere at a location spaced from said opening said segment being generally hemispherical.

14. The device as in claim 13 wherein said segment is disposed on the external periphery of the first resilient sphere.

15. The device as in claim 13 wherein said segment is disposed on the internal periphery of the first resilient sphere.

16. The device as in claim 13 wherein said opening includes a plurality of intersecting slits formed in the first resilient sphere.

17. The device as in claim 13 wherein said opening includes at least one slit formed in the first resilient sphere.

18. The device as in claim 13 wherein said opening includes a generally circular opening.

19. The device as in claim 18 wherein said opening further includes at least one slit extending outwardly from said generally circular opening.

20. The device as in claim 18 wherein said opening further includes a plurality of slits extending outwardly from said generally circular opening.

* * * * *